US010134495B2

(12) United States Patent
Easley

(10) Patent No.: US 10,134,495 B2
(45) Date of Patent: Nov. 20, 2018

(54) SHIRT WITH RADIATION BLOCKING POCKET AND HARNESS

(71) Applicant: Frederick D. Easley, San Diego, CA (US)

(72) Inventor: Frederick D. Easley, San Diego, CA (US)

(73) Assignee: Frederick D. Easley, San Diego, CA (US)

( * ) Notice: Subject to any disclaimer, the term of this patent is extended or adjusted under 35 U.S.C. 154(b) by 0 days.

(21) Appl. No.: 15/675,465

(22) Filed: Aug. 11, 2017

(65) Prior Publication Data

US 2018/0047470 A1 Feb. 15, 2018

Related U.S. Application Data

(60) Provisional application No. 62/374,529, filed on Aug. 12, 2016.

(51) Int. Cl.

| | |
|---|---|
| ***G21F 3/02*** | (2006.01) |
| ***A41B 1/08*** | (2006.01) |
| ***A41D 27/20*** | (2006.01) |
| ***A41F 1/00*** | (2006.01) |
| ***A41D 27/08*** | (2006.01) |
| ***A41D 13/00*** | (2006.01) |

(52) U.S. Cl.

CPC ..... *G21F 3/02* (2013.01); *A41B 1/08* (2013.01); *A41D 13/0007* (2013.01); *A41D 27/08* (2013.01); *A41D 27/201* (2013.01); *A41D 27/205* (2013.01); *A41F 1/002* (2013.01); *A41D 2300/32* (2013.01); *A41D 2300/322* (2013.01)

(58) Field of Classification Search

CPC .... A41D 27/205; A41D 27/201; A41D 31/02; B32B 2571/00; B32B 5/024; G21F 3/02

USPC ..... 250/515.1, 516.1; 174/254; 2/247

See application file for complete search history.

(56) References Cited

U.S. PATENT DOCUMENTS

| | | | | |
|---|---|---|---|---|
| 3,030,961 | A * | 4/1962 | Erteszek | A41C 3/06 450/41 |
| 4,266,297 | A * | 5/1981 | Atkins | F41H 1/02 2/2.5 |
| 9,445,637 | B2 * | 9/2016 | Buczkowski | A41D 27/20 |
| 9,521,788 | B2 * | 12/2016 | McConnell | A61N 1/16 |
| 9,775,428 | B2 * | 10/2017 | Johnson | A45F 5/00 |
| 2004/0023576 | A1 * | 2/2004 | Rock | D04B 1/04 442/59 |
| 2012/0060261 | A1 * | 3/2012 | Raviv | A41D 27/205 2/252 |
| 2012/0185999 | A1 * | 7/2012 | Raviv | A41D 27/205 2/247 |
| 2012/0186000 | A1 * | 7/2012 | Raviv | A41B 1/00 2/247 |
| 2012/0304357 | A1 * | 12/2012 | Highfield | A41D 1/002 2/69 |
| 2014/0366250 | A1 * | 12/2014 | Barone | A41D 27/205 2/251 |

(Continued)

*Primary Examiner* — David A Vanore

(74) *Attorney, Agent, or Firm* — Perkins Coie LLP

(57) ABSTRACT

Garments with radiation-reducing pockets and harnessing are described. A shirt can include a pocket made of a radiation-reducing material to place an electronic device such as a smartphone within. This can reduce the amount of radiation absorbed by a user's body. A harness system of the shirt can also distribute the weight of the smartphone to improve the comfort of the user.

18 Claims, 10 Drawing Sheets

(56) References Cited

U.S. PATENT DOCUMENTS

| | | | | |
|---|---|---|---|---|
| 2015/0061914 | A1* | 3/2015 | Falken | H01Q 17/005 342/1 |
| 2016/0007475 | A1* | 1/2016 | Zanesi | H05K 1/038 361/760 |
| 2016/0058079 | A1* | 3/2016 | Sexton | A41C 3/0035 2/455 |
| 2016/0262476 | A1* | 9/2016 | Crockett | H04M 1/05 |
| 2016/0285171 | A1* | 9/2016 | Moylan | H01Q 17/007 |
| 2017/0164670 | A1* | 6/2017 | Hale | A41D 27/205 |
| 2017/0271035 | A1* | 9/2017 | Sexton | G21F 3/02 |
| 2017/0347729 | A1* | 12/2017 | Goff | A41D 27/20 |
| 2018/0035576 | A1* | 2/2018 | Bostani | H05K 9/0086 |
| 2018/0047470 | A1* | 2/2018 | Easley | G21F 3/02 |

* cited by examiner

SHIRT WITH RADIATION BLOCKING POCKET AND HARNESS

CLAIM FOR PRIORITY

This application claims priority to U.S. Provisional Patent Application No. 62/374,529, entitled "A pocket on clothing or a handbag with Washable EMF-RFID radiation blocking fabric such as silver mesh fabric, is sewn on the inside of containment area to block radiation from electronic devises that emit or receive signals. The containment area on shirt pocket seal at the top of the pocket with a thin Velcro strip to prevent items from slipping out. Pursues and handbags will have zippers, Velcro, buttons or other fasteners to contain items as well," by Easley, and filed on Aug. 12, 2016. The content of the above-identified application is incorporated herein by reference in its entirety.

TECHNICAL FIELD

This disclosure relates to a shirt having a pocket with radiation-blocking material and a harness to support the weight of a device placed within the pocket.

BACKGROUND

Electronic devices such as smartphones can emit radiation, for example, radiofrequency (RF) radiation via a cellular signal transmitted by an antenna of the smartphone. Additionally, smartphones can also receive cellular signals as a form of radiation. Other types of wireless signals (e.g., WiFi signals based on the Institute of Electrical and Electronics Engineers (IEEE) 802.11 standards) can also be transmitted and received.

Often, users might want to block signals being emitted from the smartphone or received by the smartphone. For example, some users might want to reduce the amount of radiation that their body might absorb from the smartphone. Some users might also want to prevent a smartphone from receiving a signal to maintain a higher level of privacy.

DETAILED DESCRIPTION

Some of the material described in this disclosure includes a shirt having a pocket with radiation-blocking (or radiation-shielding, radiation-reducing, etc.) material to prevent a user's body from absorbing radiation emitted by an electronic device within the pocket. In one example, the shirt can include a chest pocket lined or made with a radiation-blocking material such as a metallic silver mesh fabric. If the pocket includes a smartphone, then the radiation-blocking material can prevent or reduce the amount of the radiation emitted from the smartphone that is absorbed by the user's body. This can allow for some users of the shirt to feel safer to use a smartphone as it reduces the amount of radiation absorbed, which some believe can cause various negative health consequences. Additionally, some users might want to maintain a higher level of privacy and, therefore, might want to prevent their smartphone from receiving signals. When placed in the pocket with the radiation-blocking material, signals from outside of the pocket cannot penetrate (or cannot penetrate at a sufficient level) to allow for the smartphone to pick up the signal.

Additionally, the shirt pocket can include an enclosure or fastening mechanism, for example, Velcro®, such that the smartphone placed in the pocket may not fall out when the user bends over. The shirt can also include a harness system to support the weight of the smartphone within the pocket. For example, the harness system can include infused material on the inside of the shirt to distribute the weight of the smartphone along the user's neck, shoulder, and/or arms along the user's front and/or back. This can prevent the shirt from sagging around the pocket and deforming the neck of the shirt and, therefore, can be more comfortable for a user to wear with a smartphone in the pocket.

Figure 1:
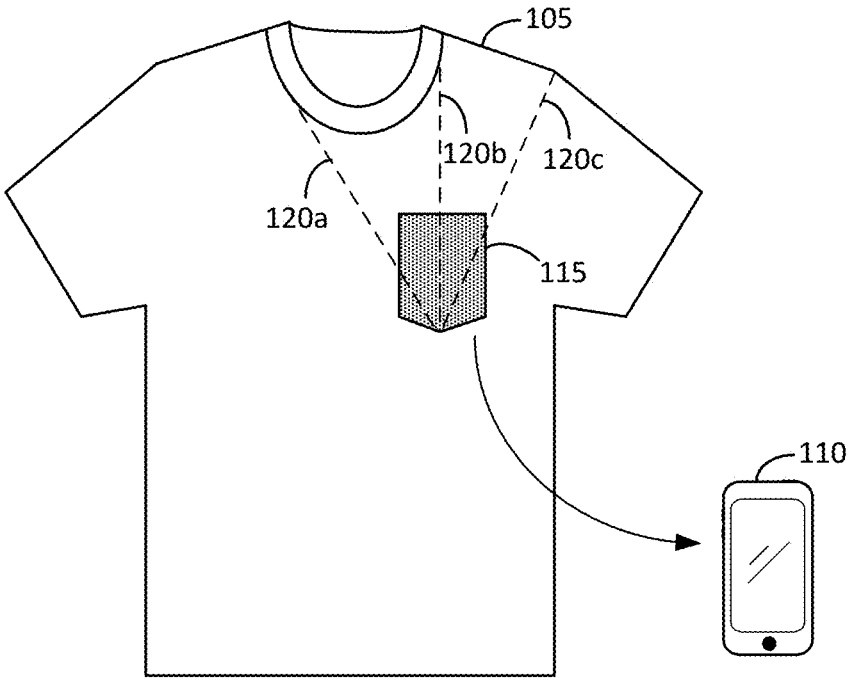
FIG. 1 illustrates an example of a shirt with a radiation-blocking pocket and a harness to support the weight of an electronic device placed within the pocket.

In more detail, FIG. 1 illustrates an example of a shirt with a radiation-blocking pocket and a harness to support the weight of an electronic device placed within the pocket. In FIG. 1, shirt 105 can include pocket 115 for storing smart phone 110. Though smartphone 110 is used in this example, pocket 115 can also store other electronic devices, for example, tablets, smartwatches, etc.

Pocket 115 of shirt 105 can include a radiation-blocking material, for example, a metallic silver mesh fabric or other type of electromagnetic field (EMF) blocking (or shielding) fabric. Some examples of radiation-blocking material include Hertzcloth®, Sanisilver®, TechniCot®, and Wear®. Some of the material might include multiple layers of fabric, for example, one layer or side can provide radiation-blocking or reducing, and another side or layer can be cotton. The use of metallic material that is arranged in a mesh (e.g., metallic fibers or material arranged in a grid-like pattern) can prevent or reduce the transmission of radiation through pocket 115. As a result, if smartphone 110 is placed within pocket 115 of shirt 105, the amount of radiation generated by smartphone 110 (e.g., as its antenna transmits signals) that is allowed to "escape" the pocket via transmission through the pocket of the shirt can be reduced or blocked. This results in the user's body absorbing less radiation and, therefore, some users feeling safer to keep smartphones close to the body.

Additionally, pocket 115 can include an enclosure mechanism to house or contain smartphone 110 within pocket 115 and prevent smartphone 110 from slipping out. For example, the metallic silver mesh fabric used to line or make pocket 115 can include Velcro® on opposite sides (e.g., a hook side of the Velcro® on the side of pocket 115 closer to the user's body and an attachment or loop side of the Velcro® on the side farther away from the user's body, or vice versa). Thus, when the user places smartphone 110 within pocket 115, this can involve unfastening the Velcro®, placing smartphone 110 within pocket 115, and then fastening the Velcro® back together. This results in smartphone 110 being fully or almost fully contained by the metallic silver mesh fabric and, therefore, the radiation absorbed by the user that is emitted by smartphone 110 can be reduced or blocked. Additionally, when the user bends over while smartphone 110 is within pocket 115, smartphone 110 can stay safely within pocket 115 rather than falling out. Thus, smartphone 110 can be safely placed in a location and the likelihood of damage or loss of smartphone 110 can be reduced.

Placing smartphone 110 within pocket 115 can sometimes be uncomfortable for a user. For example, the weight of smartphone 110 can cause shirt 105 to sag downward, which results in the user's neck being tugged on by shirt 105. In FIG. 1, shirt 105 can include a harness that can distribute the weight of smartphone 110 within pocket 115 around the user's neck, shoulders, arms, and/or back over the shoulders. This can improve the user's comfort as well as the aesthetic look of having smartphone 110 within pocket 115.

For example, in FIG. 1, fusible interfacing can be ironed-on within the inside of shirt 105 (e.g., on a side of shirt 105 that is opposite of pocket 115 and is closer to the body of the user). In FIG. 1, the harness can include fusible interfacing 120*a*, 120*b*, and 120*c* that can be strips of fusible interfacing that are ironed on the interior of shirt 105. Some examples of fusible interfacing can be fusible interfacing such as Pellon® products such as Easy Shaper ES114, 931TD, P44F, SF101, 906F, and 911FF. Other examples of fusible interfacing can include fusible fabric that can be ironed on. Though many of the examples described herein involve ironing fusible interfacing upon shirt 105, in some implementations it can be attached through other techniques such as adhesive (e.g., glues), stitching, etc. On one end, each of fusible interfacing 120*a*, 120*b*, and 120*c* can each be anchored upon pocket 115. The other ends of fusible interfacing 120*a*, 120*b*, and 120*c* can be anchored around the neck, arms, and/or shoulder areas of shirt 105. This disperses the weight of smartphone 110 within pocket 115 to the user's neck, arm, and shoulders and, therefore, prevents shirt 105 from sagging due to the weight of smartphone 110 and increases the comfort of the user as the user's neck is not tugged on with the weight of smartphone 110.

In FIG. 1, pocket 115 includes a bottom corner due to pocket 115 having an angled shape on the bottom. That is, the bottom of pocket 115 (e.g., the portion of the pocket closer to the ground when shirt 105 is worn) tapers into a point or corner for each of fusible interfacing 120*a*, 120*b*, and 120*c* to anchor or join at. Thus, each of fusible interfacing 120*a*, 120*b*, and 120*c* can anchor or join to the same or similar position upon the back side of shirt 105 at a similar location behind pocket 115. By having a bottom corner due to the angled bottom shape, much of the weight of smartphone 115 can be concentrated there and, therefore, the weight can be more easily distributed by having fusible interfacings 120*a*, 120*b*, and 120*c* anchored in that relative location.

As depicted in FIG. 1, fusible interfacing 120*a* extends from the bottom corner of pocket 115 to one side of the neck of shirt 105. Fusible interfacing 120*b* extends from the bottom corner of pocket 115 to the other side of the neck of shirt 105. Fusible interfacing 120*c* extends from the bottom corner of pocket 115 to a shoulder seam of shirt 105 (e.g., where the shoulder of shirt 105 is sewn onto the body of shirt 105). As previously discussed, this distributes the weight of smartphone 110 from pocket 115 to the neck, shoulder, and/or arm of the user.

Figure 4:
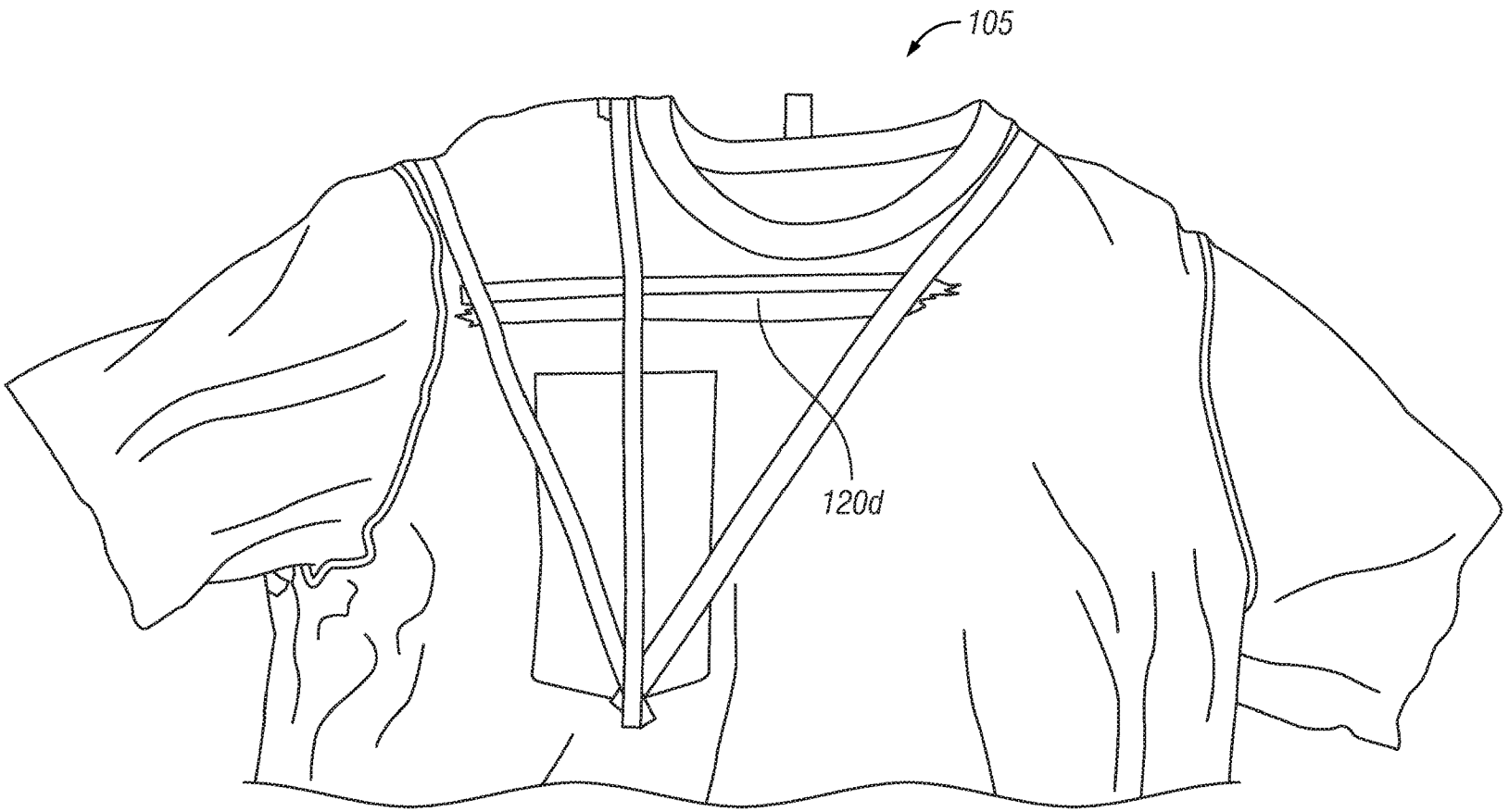
FIG. 4 illustrates an example of fusible interfacing placed on a front side of a shirt to distribute weight of an electronic device placed in a pocket.

The arrangement of fusible interfacings 120*a*, 120*b*, and 120*c* can be different in other examples, For example, fusible interfacing 120*b* (or another fusible interfacing depicted in the example of FIG. 1) might be excluded. In another example, more strips of fusible interfacing can be placed. In another example, another fusible interfacing can be placed horizontally across shirt 105 such that it intersects each of fusible interfacings 120*a*, 120*b*, and 120*c*. For example, in FIG. 4, fusible interfacing 120*d* illustrates another fusible interfacing placed across the fusible interfacings joined at the bottom corner of the pocket (e.g., fusible interfacings 120*a*, 120*b*, and 120*c*).

Figure 5:
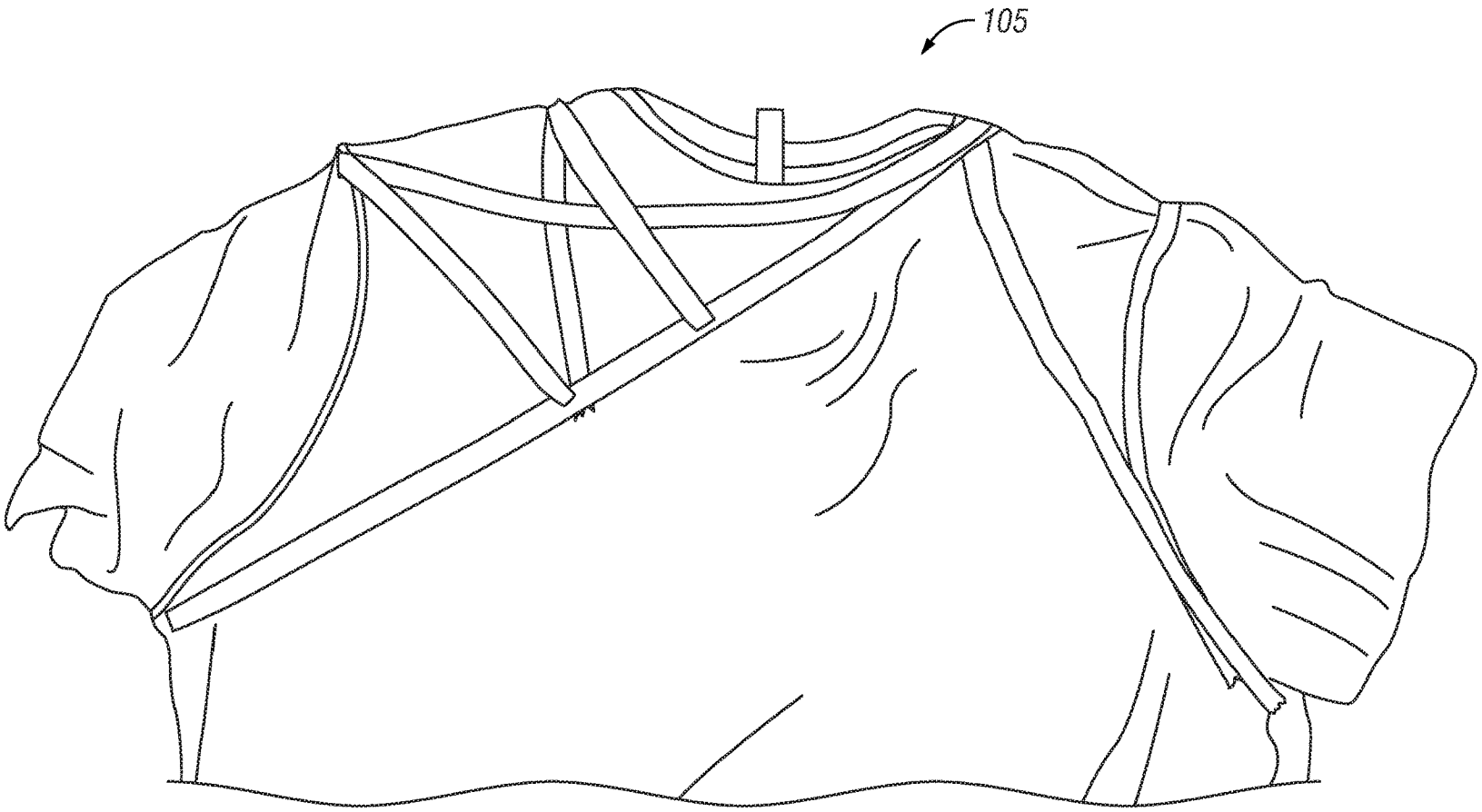
FIG. 5 illustrates an example of fusible interfacing placed on a back side of a shirt to distribute weight of an electronic device placed in a pocket.

Additionally fusible interfacing can also extend or be included upon the back of shirt 105. For example, in FIG. 5, shirt 105 includes additional fusible interfacing for distributing weight around the neck, arms, and/or shoulders of the user while wearing shirt 105 with smartphone 110 within pocket 115. In FIG. 5, the backside of shirt 105 includes fusible interfacing placed along shoulder seams as well as fusible interfacing extending from the neck and terminating at the armpits of the arms rather than extending towards the front side of the shirt. For example, some of the fusible interfacing extends from the same side of the neck but separate fusible interfacing terminate at the bottom of the shoulder seam (e.g., in the armpit area) of opposite shoulders. Thus, at least two fusible interfacings can extend from the same portion or area of the neck of shirt 105 but terminate at different shoulder seams on the back side of shirt 105. Additionally, one shoulder can include fusible interfacing along the entire back side of the shoulder seam, as depicted in FIG. 5.

Other types of material can be used in place of fusible interfacing. Additionally, some of the material may be placed upon shirt 105 via techniques other than ironing (e.g., more than applying heat as the fusible interfacing is placed upon shirt 105). For example, thread or other types of materials such as hemp string, light yarn, polypropylene line, vinyl lines, etc. can be stitched, placed, disposed upon, etc. to provide the harnessing to distribute the weight of smartphone 110 in a similar manner.

Thus, by having pocket 115 lined or made of radiation-blocking material (e.g., metallic silver mesh fabric), an enclosure mechanism to prevent smartphone 110 from slipping out of pocket 115, and a harness to distribute the weight of smartphone 110, a user can easily and comfortably house smartphone 110 within pocket 115 while reducing the body's exposure to radiation. Additionally, the user's privacy can be maintained by preventing or reducing signals that can be obtained by smartphone 110 while it is within pocket 115.

Figure 2A:
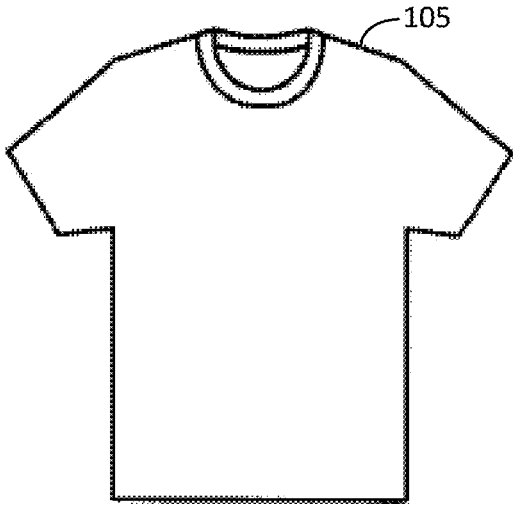
FIGS. 2A-H illustrate an example of assembling a shirt with a radiation-blocking pocket and a harness.
Figure 2B:
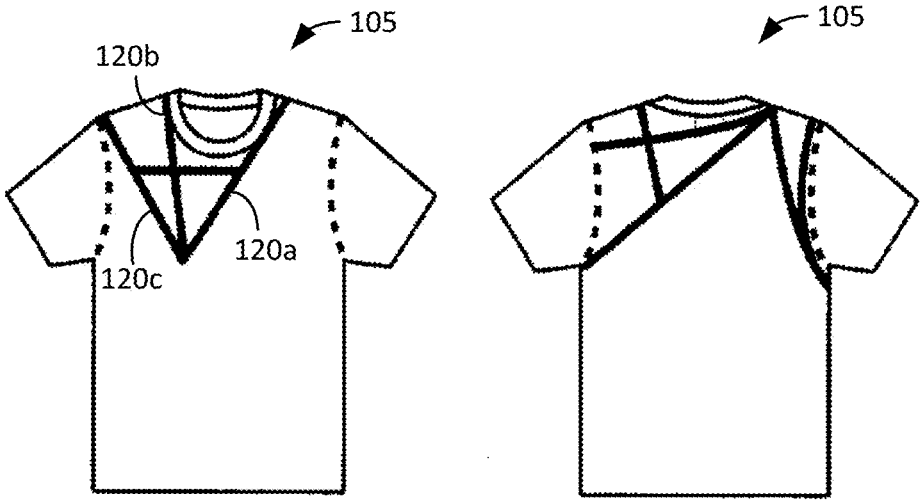
Figure 2C:
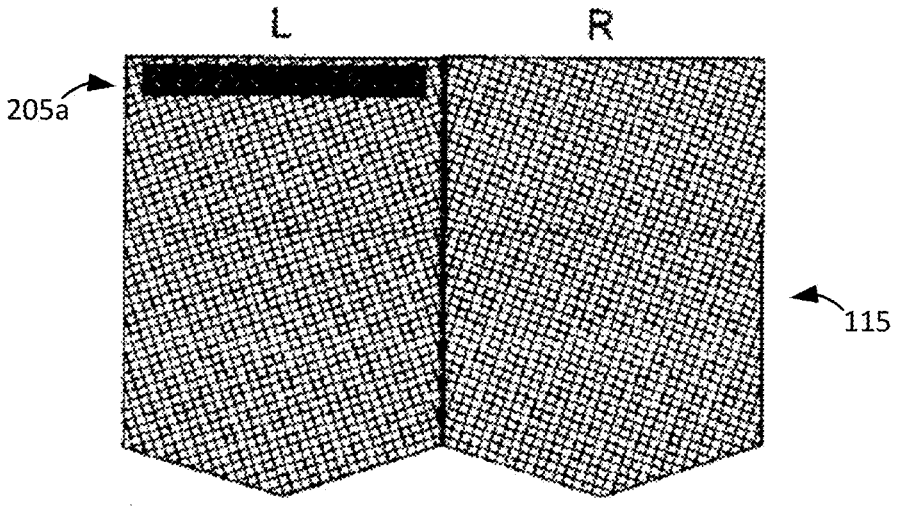
Figure 2D:
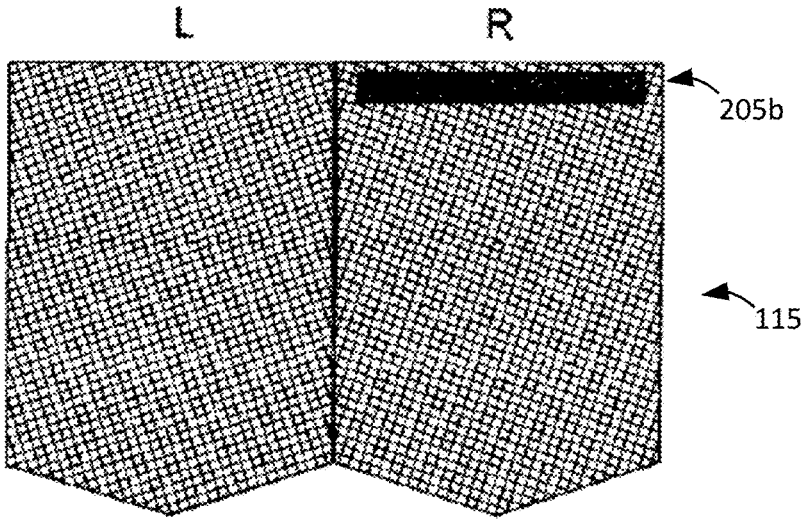

FIGS. 2A-H illustrate an example of assembling a shirt with a radiation-blocking pocket and a harness. In FIG. 2A, shirt 105 can be obtained and can be inverted such that the side of shirt 105 that would normally be closer to the user's body when worn can be exposed (e.g., the side without the pocket is exposed). In FIG. 2B, fusible interfacing can be applied to shirt 105. For example, fusible interfacings 120*a*, 120*b*, and 120*c* can be disposed upon the front side of shirt 105, along with additional fusible interfacing such as the horizontal fusible interfacing depicted as intersecting each of fusible interfacings 120*a*, 120*b*, and 120*c*. The back side of shirt 105 can include additional fusible interfacing, as previously discussed. In FIG. 2C, pocket 115 can be a metallic silver mesh material that can block or reduce emission of radiation, as previously discussed. Velcro 205*a* can be placed upon one side of pocket 115. As depicted in FIG. 2C, pocket 115 is folded upon the middle and, as discussed later herein, can be stitched along the middle, bottom, and right side to shirt 105 while leaving the top capable of being opened or closed using Velcro 205*a* and Velcro 205*b* of FIG. 2D. In FIG. 2D, Velcro 205*b* is placed on the other side of pocket 115. As previously discussed, one of Velcro 205*a* and 205*b* can be the be the "hook" side and the other can be the "loop" side. In other implementations, the enclosure or fastening mechanism can be a button, zipper, magnets, or other types of fasteners that can be used to open and close pocket 115 while smartphone 110 is within.

Figure 2E:
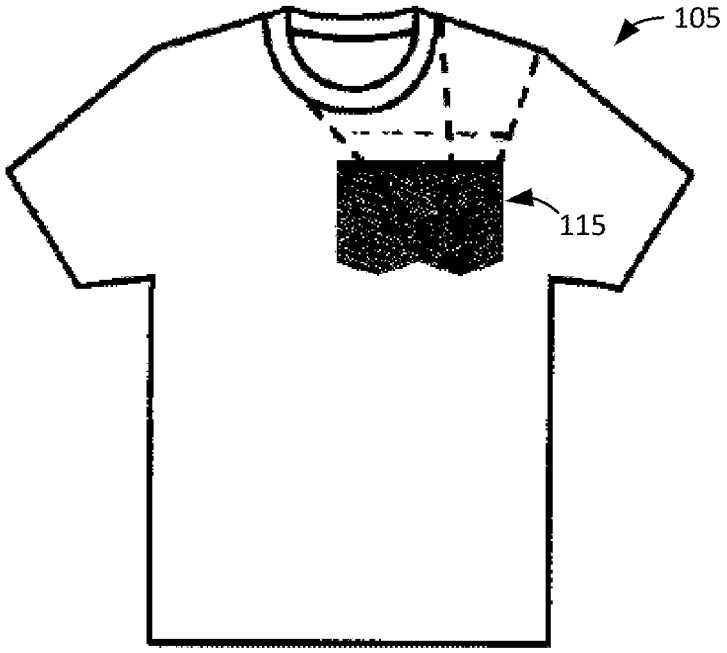
Figure 2F:
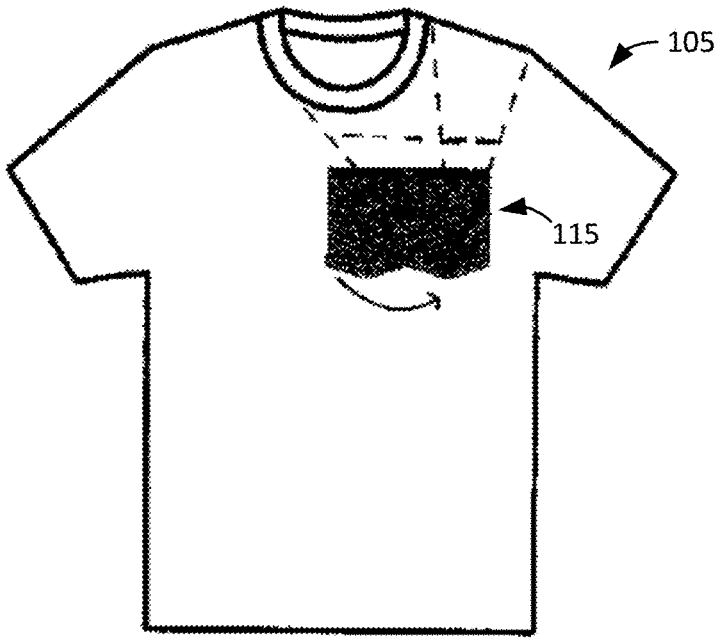
Figure 2G:
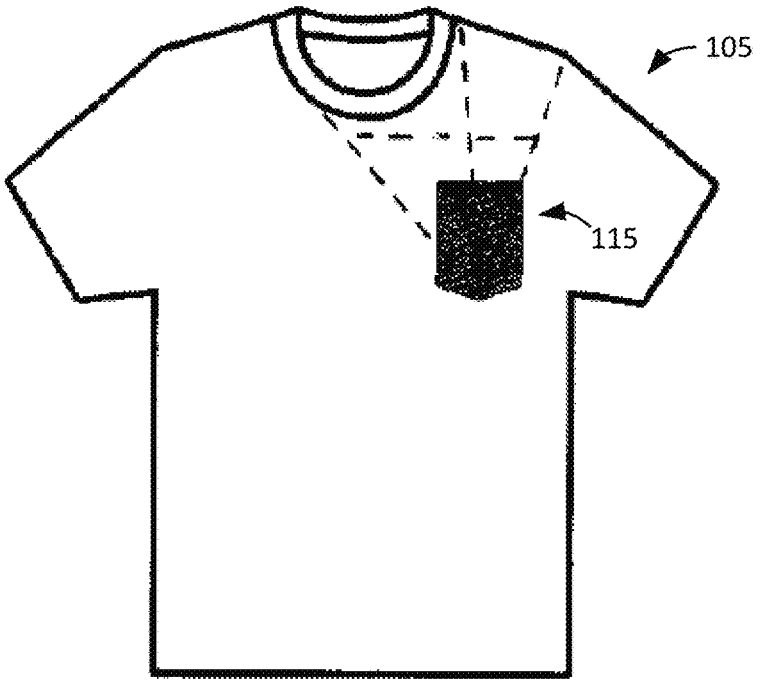

Next, in FIGS. 2E and 2F, pocket 115 can be placed upon the front of shirt 105. As depicted therein, the shirt is inverted such that pocket 115 is placed upon the other side of shirt 105 from the fusible interfacing that was placed in FIG. 2B. However, in other implementations, pocket 115 can be placed upon shirt 105 before the placement of the fusible interfacing. In FIG. 2E, pocket 115 can be folded and sewed, as previously discussed, resulting in pocket 115 being sewed upon shirt 105 as depicted in FIG. 2G.

Figure 2H:
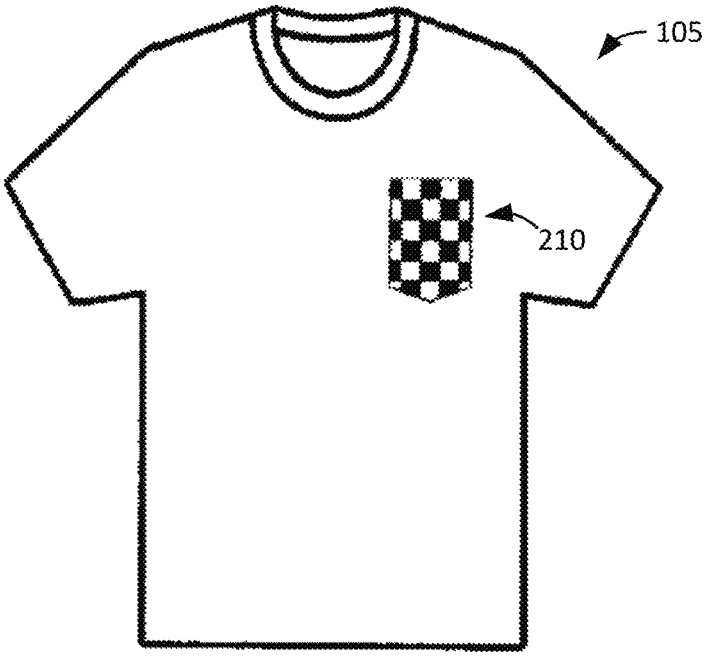

In some implementations, a decorate fabric can be sewed upon pocket 115. This might be done because the metallic silver mesh material used to provide radiation blocking might not be aesthetically pleasing and, therefore, as depicted in FIG. 2H, a decorative fabric 210 can be sewed upon pocket 115. The decorative fabric, or outer cover design fabric for pocket 115, can also prevent or reduce the abrasive deterioration of the metallic silver mesh material of pocket 115 during a wash (e.g., in a laundry washing machine). For example, after a sufficient number of washes (e.g., hundreds or thousands of washes), the metallic silver mesh material might lose some of its radiation (or signal) blocking or reducing capabilities.

Figure 3:
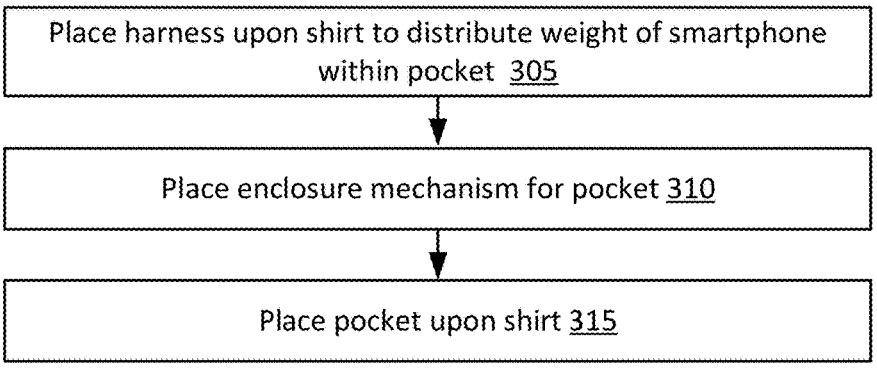
FIG. 3 illustrates an example of a block diagram for assembling a shirt with a radiation-blocking pocket and a harness.

FIG. 3 illustrates an example of a block diagram for assembling a shirt with a radiation-blocking pocket and a harness. In FIG. 3, a harness can be placed upon the shirt to distribute the weight of a smartphone to be placed within a pocket (305). For example, as previously discussed, fusible interfacing can be ironed upon the interior of the front and back of the shirt. An enclosure mechanism can be placed upon the pocket (310). For example, as previously discussed, Velcro®, buttons, magnets and/or metal, etc. can be placed upon metallic silver mesh material that is to be used to form a pocket and provide radiation blocking or shielding for a smartphone or other electronic device to be placed inside the pocket. Next, the pocket can be placed upon the shirt (315). For example, the pocket can be sewed upon the shirt at a location that is "anchored" by the fusible interfacing placed to form the harness.

In some implementations, the materials described herein can be machine washable. For example, the metallic silver mesh material, fusible interfacing, and other materials discussed herein can be washed in a laundry washing machine and dried using a laundry drying machine.

In some implementations, Velcro® might warp when heat is applied, for example, when shirt 105 is dried using a laundry drying machine. To prevent or reduce the warping, a thin plastic rib (e.g., a plastic bar) can be placed behind one or both of the Velcro® layers used as the attachment or fastening mechanism for pocket 115. This can provide some further rigidity to the Velcro® and, therefore, can help prevent or reduce the warping. In some implementations, heat resistant Velcro® such as heat resistant polypropylene, Hook 81, Loop 9000, etc. can be used.

In some implementations, pocket 115 can include a small cut-out for an antenna of smartphone 110 to receive some signals (e.g., signals related to cellular phone calls). Additionally, as disclosed later herein, the small cut-out can also be used to provide a camera lens of smartphone 110 with a view outside of pocket 115 to generate image data. The small cut-out can allow for enough cell phone signal to be received by smartphone 110 so that it can still be operational, but still prevent some of the radiation from being absorbed into the body of the user. In some implementations, a flap can be cut into pocket 115 such that one side is attached to pocket 115. The flap can then be opened or closed. This can allow for the user to allow some of the cell phone signal to be received by smartphone 110 and, therefore signals to be received by the phone or emitted from the phone outside of pocket 115 (e.g., by opening the flap such that the interior of pocket 115 is exposed). When the user wishes to keep the phone enclosed, then the flap can be let go and it can close if the edge of the flap is positioned at the top. That is, the flap can close the exposure of the inside of pocket 115 merely through gravity.

Figure 6:
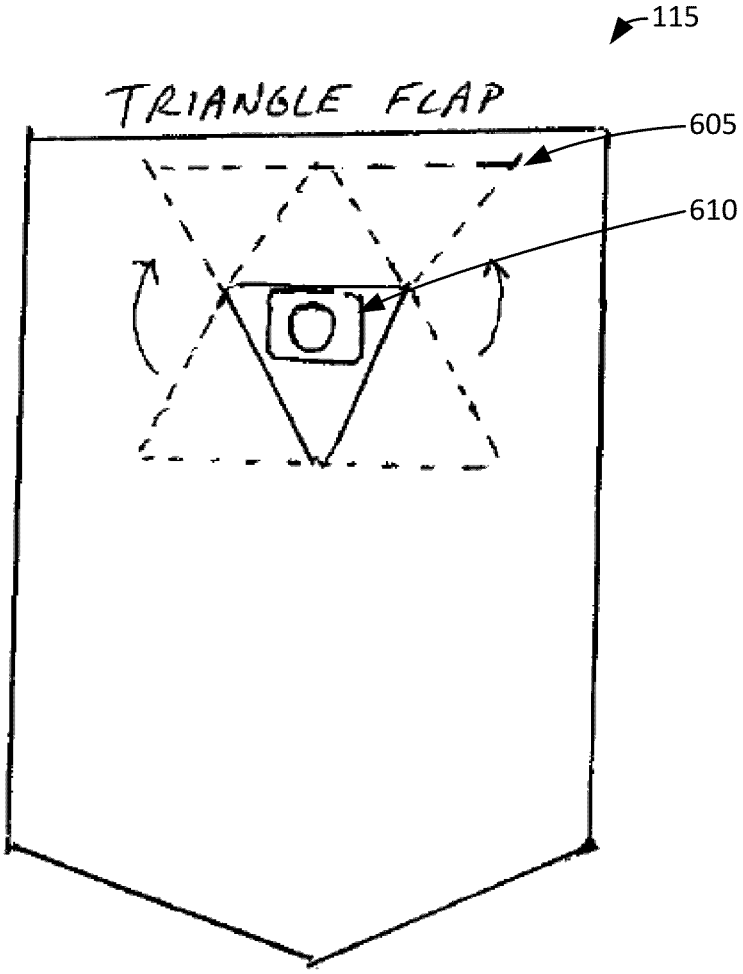
FIG. 6 illustrates an example of a flap that can expose the interior of a pocket.

In some implementations, the flap can be positioned to allow for a camera of smartphone 110 to be exposed to the outside of pocket 115. Thus, a user can decide to take a photo by opening the flap. For example, in FIG. 6, a triangular flap can be positioned opened or closed to reveal or hide a camera lens 610 of smartphone 110. The opening to reveal camera lens 610 can be positioned on pocket 115 based on the type of smartphone 110 placed in the pocket. For example, some smartphones might result in camera lens 610 in a corner of pocket 115 and other smartphones might result in camera lens 610 in the middle of pocket 115 and, therefore the openings or flaps can be placed in the proper position based on the type of smartphone 110 to be used with shirt 105.

Figure 7:
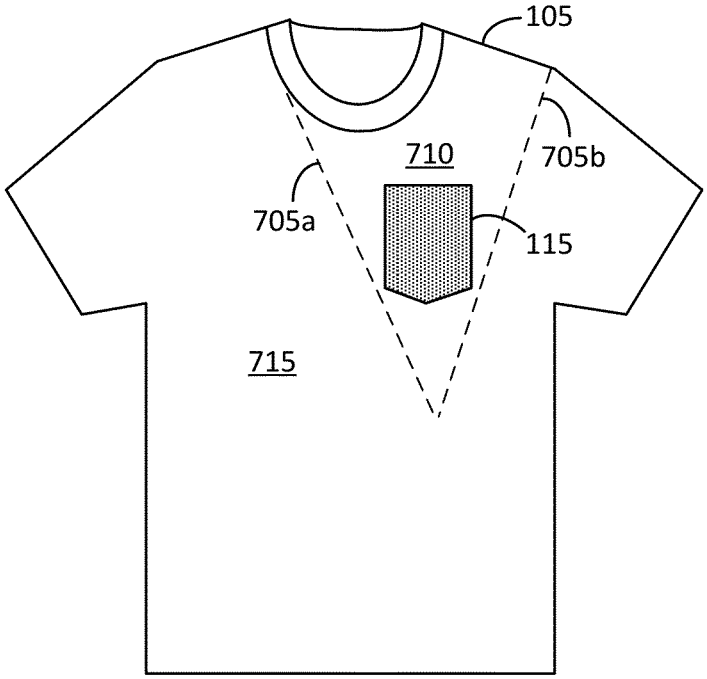
FIG. 7 illustrates another example of a shirt with a radiation-blocking pocket and a harness.

FIG. 7 illustrates another example of a shirt with a radiation-blocking pocket and a harness. In FIG. 7, shirt 105 can include portions 710 and 715 which can be made of different materials. For example, portion 710 might be a different piece of fabric that is sewed upon (e.g., on top of) portion 715. Stitching 705*a* and 705*b* can, therefore, provide the harness system as previously discussed regarding the fusible interfacing. Thus, in FIG. 7, fusible interfacing is not ironed upon the backside of shirt 105. Rather, when the fabric of portion 710 is stitched on, the stitching itself can provide the functionality of the harness to distribute the weight of electronic devices placed within pocket 710. In some implementations, portion 710 and 715 can be different designs (e.g., different colors, graphics, etc.). In some implementations, stitching for attaching portion 710 to portion 715 of shirt 105 can also include stitching around the neck collar and shoulder seam such of the front of shirt 105.

The aforementioned examples describe a shirt with a pocket having radiation-blocking (or reducing) material, a fastening mechanism, and a harness to distributed the weight of a smartphone or other electronic device placed within the pocket. The same techniques (e.g., pocket, fastening mechanism, and/or harness) can also be used with handbags, purses, luggage, messenger bags, briefcases, as well as other types of garments such as jackets, pants, cargo shorts, shorts, sweatshirts, hoodies, sweaters, blazers, sports coats, etc.

Additionally, the shirt can be made of the silver metallic mesh material and the pocket, fastening mechanism, and harness can be used with the shirt.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A shirt, comprising:

a pocket made of a radiation-reducing metallic silver mesh fabric and configured to hold an electronic device and block or reduce radiation emitted from the electronic device and absorbed by a user when wearing the shirt, and configured to block or reduce radiation received by the electronic device when it is within the pocket;

a fastening mechanism attached to the pocket and configured to keep the electronic device within the pocket; and a harness system configured to distribute weight of the electronic device when placed in the pocket around a neck, a shoulder, and/or arm areas of the shirt when worn by the user, wherein the harness system includes a first portion placed to distribute weight of the electronic device upon a first side of a neck of the shirt, and a second portion placed to distribute the weight of the electronic device upon a second side of the neck of the shirt, the first side and the second side being different sides of the neck.

2. The shirt of claim 1, wherein the fastening mechanism includes one or more of a hook and loop fastener, a button, a zipper, or a magnet.

3. The shirt of claim 1, wherein the harness system includes fusible interfacing upon a side of the shirt opposite from the pocket.

4. The shirt of claim 1, wherein the pocket is placed upon a chest area of the shirt.

5. The shirt of claim 1, wherein the harness system includes a third portion configured to further distribute the weight of the electronic device upon a shoulder seam of the shirt.

6. The shirt of claim of claim 1, further comprising:

a fabric placed upon the pocket made of the radiation-reducing metallic silver mesh fabric.

7. The shirt of claim 1, wherein the harness system includes fusible interfacing on a front side and a back side of a portion of the shirt opposite from the pocket.

8. The shirt of claim 1, wherein the harness system includes fusible interfacing ironed upon the shirt.

9. The shirt of claim 1, wherein the harness system includes stitching placed to distribute the weight of the electronic device.

10. A garment, comprising:

a pocket including a radiation-reducing material and configured to hold an electronic device; and a harness system configured to distribute weight of the electronic device away from the pocket when the electronic device is placed in the pocket, wherein the harness system includes a first portion placed to distribute weight of the electronic device upon a first side of a neck of the garment, and a second portion placed to distribute the weight of the electronic device upon a second side of the neck of the garment, the first side and the second side being different sides of the neck.

11. The garment of claim 10, wherein the harness system is configured to distribute the weight of the electronic device to a neck, a shoulder, and/or an arm area of the garment.

12. The garment of claim 10, further comprising:

a fastening mechanism attached to the pocket and configured to keep the electronic device within the pocket, wherein the fastening mechanism includes one or more of a hook and loop fastener, a button, a zipper, or a magnet.

13. The garment of claim 10, wherein the harness system includes fusible interfacing upon a side of the garment opposite from the pocket.

14. The garment of claim 10, wherein the pocket is placed upon a chest area of the garment.

15. The garment of claim 10, wherein the harness system includes a third portion configured to further distribute the weight of the electronic device upon a shoulder seam of the garment.

16. The garment of claim of claim 10, further comprising:

a fabric placed upon the pocket.

17. The garment of claim 10, wherein the harness system includes fusible interfacing on a front side and a back side of a portion of the garment opposite from the pocket.

18. The garment of claim 10, wherein the harness system includes fusible interfacing ironed upon the garment.

* * * * *